US007709714B2

(12) United States Patent
Harbaugh et al.

(10) Patent No.: US 7,709,714 B2
(45) Date of Patent: May 4, 2010

(54) MUSICAL INSTRUMENT HARNESS

(76) Inventors: Steven R. Harbaugh, 1042 Roanoke Dr., Westfield, IN (US) 46074; Joseph M. Kunzer, 16251 Remington Dr., Fishers, IN (US) 46037

( * ) Notice: Subject to any disclaimer, the term of this patent is extended or adjusted under 35 U.S.C. 154(b) by 0 days.

(21) Appl. No.: 12/286,639

(22) Filed: Oct. 1, 2008

(65) Prior Publication Data

US 2009/0084245 A1 Apr. 2, 2009

(51) Int. Cl.
*G10D 3/00* (2006.01)
*G10G 5/00* (2006.01)

(52) U.S. Cl. ..... 84/327; 248/443; 224/264

(58) Field of Classification Search ..... 84/327; 248/443; 224/264
See application file for complete search history.

(56) References Cited

U.S. PATENT DOCUMENTS 148,744 A * 3/1874 Parent ..... 182/8
770,761 A * 9/1904 Lemly ..... 224/649
1,810,519 A * 6/1931 Gerhart ..... 84/327
2,996,228 A * 8/1961 Bauman ..... 224/184
3,583,600 A * 6/1971 Scott ..... 221/185
3,972,238 A * 8/1976 Thatcher ..... 482/128
4,320,863 A * 3/1982 Lyer et al. ..... 224/259
D267,598 S * 1/1983 Lyer et al. ..... D3/216
4,461,411 A * 7/1984 Harrow ..... 224/617
4,630,763 A * 12/1986 Friedman ..... 224/259
4,802,613 A * 2/1989 Tierney ..... 224/606
5,184,764 A * 2/1993 Orovan et al. ..... 224/636
5,215,239 A * 6/1993 Walters, Jr. ..... 224/259
D348,153 S * 6/1994 Eldridge ..... D29/101.1
5,332,137 A * 7/1994 Violette ..... 224/257
5,497,923 A * 3/1996 Pearson et al. ..... 224/639
5,619,955 A * 4/1997 Nelson ..... 119/857
5,772,091 A * 6/1998 Lackner ..... 224/265
5,873,503 A * 2/1999 Atherton et al. ..... 224/259
5,915,606 A * 6/1999 Jensen ..... 224/148.6
5,988,098 A * 11/1999 Hillhouse ..... 114/347
6,006,970 A * 12/1999 Piatt ..... 224/257
6,040,509 A * 3/2000 Fanella ..... 84/280
D435,168 S * 12/2000 Momburg ..... D3/215
6,199,731 B1 * 3/2001 Lehoux ..... 224/260
6,698,631 B1 * 3/2004 Haskins ..... 224/148.4
D499,553 S * 12/2004 Millard ..... D3/327
7,009,097 B1 * 3/2006 Terplivetz ..... 84/327
7,051,910 B2 * 5/2006 Sprague et al. ..... 224/638
7,059,503 B2 * 6/2006 Andersen ..... 224/579
7,353,779 B2 * 4/2008 Altieri ..... 119/770
7,431,324 B2 * 10/2008 Britton et al. ..... 280/658
2004/0130118 A1 * 7/2004 Britton et al. ..... 280/204
2009/0084245 A1 * 4/2009 Harbaugh et al. ..... 84/327

* cited by examiner

*Primary Examiner*—Jeffrey Donels
*Assistant Examiner*—Robert W Horn
(74) *Attorney, Agent, or Firm*—Kyle S. Brant

(57) ABSTRACT

A guitar or musical instrument harness is disclosed that includes a waist belt and a shoulder strap. A circular or oval loop is attached to the waist belt. The belt is worn by the user so that the loop is situated over the spine of the user. The shoulder strap is disposed through the loop and the distal ends extend upward along the back and over the shoulders of the user. The strap includes attachment holes or apertures at the distal ends thereof to receive guitar strap buttons mounted on a guitar. The strap also includes typical length adjustment features. An alternate embodiment includes an additional mounting ring clip through which the strap is inserted. The mounting ring clip is removably attachable to the loop portion of the waist belt.

3 Claims, 4 Drawing Sheets

MUSICAL INSTRUMENT HARNESS

FIELD OF THE INVENTION

This invention relates in general to musical instrument accessories and more particularly to harnesses worn by a user that aid in supporting the weight of a musical instrument.

BACKGROUND OF THE INVENTION

The weight of some guitars and musical instruments is quite heavy and uncomfortable to hold over long periods of time while playing the instruments. Various suspension systems for supporting musical instruments on the front of the body are known in the art. A type of suspension strap commonly used with guitars is a single strap positioned the neck and shoulders that attaches in two locations to a musical instrument. The problem with such straps is they rest on very sensitive muscles close to the player's neck and shoulders. Within a short period of time, the musician can experience fatigue and discomfort from the strap. Some instrument support mechanisms are simply cumbersome and ineffective in providing a wide range of motion or movement of the instrument versus the musicians body position or posture. The present invention is directed to improving the distribution of weight to make playing a heavy musical instrument a more enjoyable experience and more comfortable to the musician while providing a mechanism for easy movement of the musical instrument into various playing positions.

SUMMARY OF THE INVENTION

A musical instrument harness, according to one aspect of the present invention, includes a waist belt adapted to be worn about the waist of a user, a mounting ring attached to said waist belt, an elongated harness strap positioned within and through said mounting ring and sized in length to extend over both shoulders of the user when said waist belt is situated with said mounting ring disposed adjacent the spine of the user thereof, and means for attaching a musical instrument situated at the distal ends of said elongated harness strap.

One object of the present invention is to provide an improved musical instrument harness.

Another object of the present invention is to provide a musical instrument harness that redistributes the forces created by the weight of the musical instrument on the body.

Yet another object of the present invention is to provide a musical instrument harness with added comfort features that is convenient to wear and remove.

Still another object of the present invention is to provide a more ergonomic musical instrument harness that includes a rapid change mechanism for detaching and attaching different instruments previously equipped with a strap in accordance with the present invention.

These and other objects of the present invention will become more apparent from the following description of the preferred embodiments.

DESCRIPTION OF THE PREFERRED EMBODIMENTS

Figure 1:
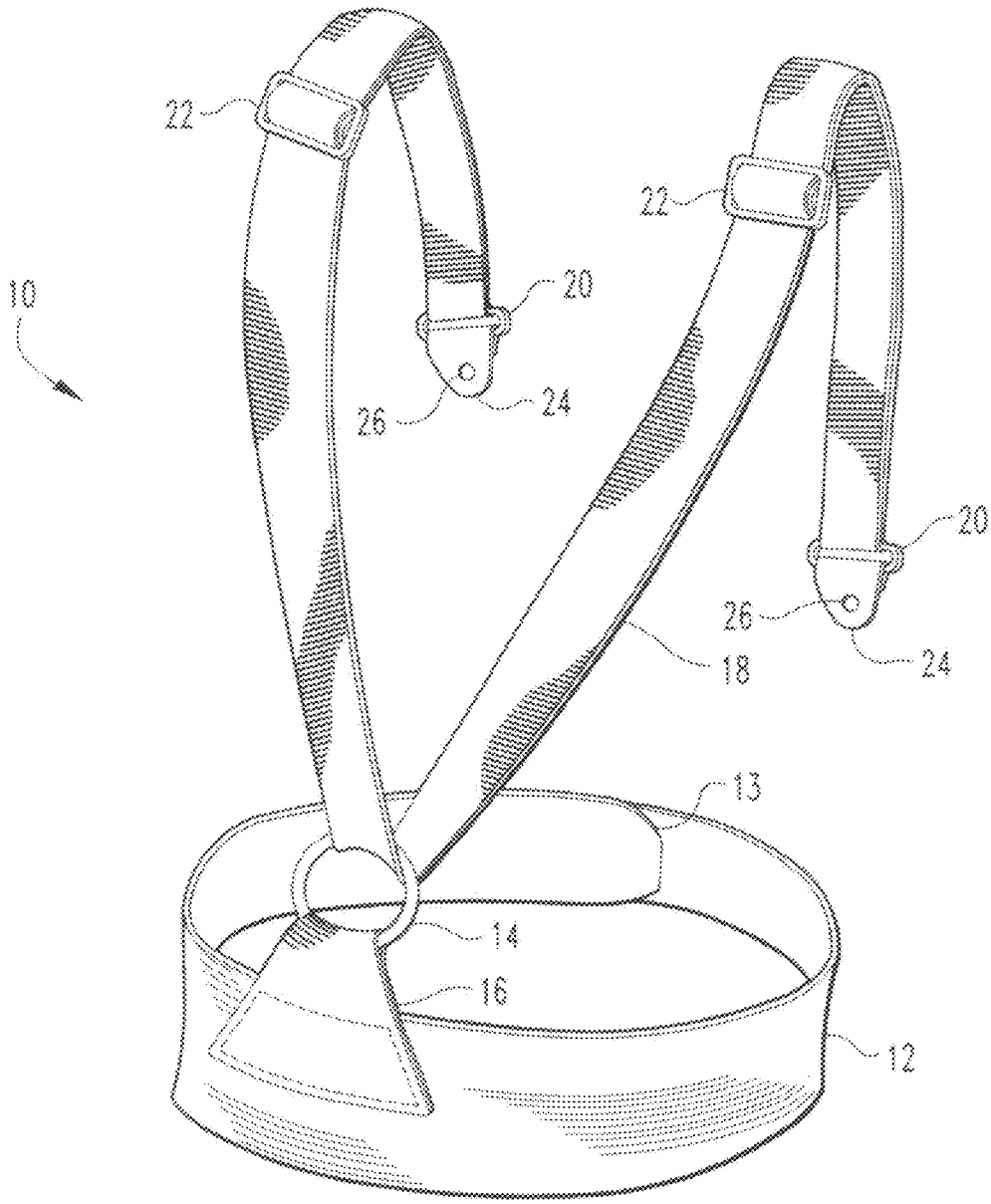
FIG. 1 is a perspective view of a musical instrument harness according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a musical instrument harness 10 according to one aspect of the present invention is shown. Harness 10 includes a waist belt 12, a transfer ring or mounting ring 14, a ring mounting portion 16, and an adjustable shoulder strap 18. Ring 14 is rotatably secured to belt 12 by mounting portion 16. Strap 18 is inserted through ring 14 attached to mounting portion 16 which is constructed of strong resilient fabric or an elastic material that attached or sewn to belt 12. The distal ends of strap 18 are inserted through brackets 20 and looped back and secured to triple bar strap adjustment brackets 22. Such an arrangement is typical of musical instrument straps providing length adjustment of the straps, and further discussion herein should not be required. Mounting tongues 24 are pivotally attached to brackets 20 and include mounting holes or apertures 26 therein for receiving, for example, guitar strap buttons well known in the guitar art.

Waist belt 12 is preferably a waist support belt such as CorFit Lumbosacral Belt Item No. 7000 manufactured by Core Products International, Inc. and may be viewed at www.coreproducts.com via the internet. Such belts include hook and loop fasteners at 13 to secure belt 12 about the waist of the user, yet traditional mounting straps and buckles are also contemplated as alternatives in the construction of belt 12. It should be noted that belt 12 may be constructed of any convenient resilient or flexible material, including leather or imitation leather, strong fabrics, elastomeric materials or the like. Strap 18 is constructed of flexible and durable fabric well known in the art of guitar straps such as nylon or leather. Mounting portion 16 is constructed from nylon strapping, leather or imitation leather material, or other suitably sturdy cloth material having resilient and flexible properties yet sufficiently strong to support the weight of a guitar. Transfer ring 14 is made from metal, however, high strength manmade composites such as reinforced graphite based materials or plastics may also be used. Mounting tongues 24 are typically made from leather or suitable similar material and are well known in the art. Though ring 14 is shown to be circular, it is contemplated that ring 14 may have any number of geometrically closed loop shapes, such as triangular, square, pentagonal, hexagonal etc.

Operationally speaking, musical instrument harness 10 is worn by attaching belt 12 about the waist. Straps 18 extend upward along the back and over the shoulders of the user and attach to a musical instrument such as a guitar in traditional fashion. The weight of the musical instrument is distributed over the shoulders as compared with traditional guitar or musical instrument harnesses that exert forces on the back of the neck. Though the embodiment of FIG. 1 discloses mounting tongues adapted to attach to the strap buttons of a guitar, it is contemplated that the tongues may be altered to include snaps, clips or metallic hooks to mechanically attach to any musical instrument.

Figure 2:
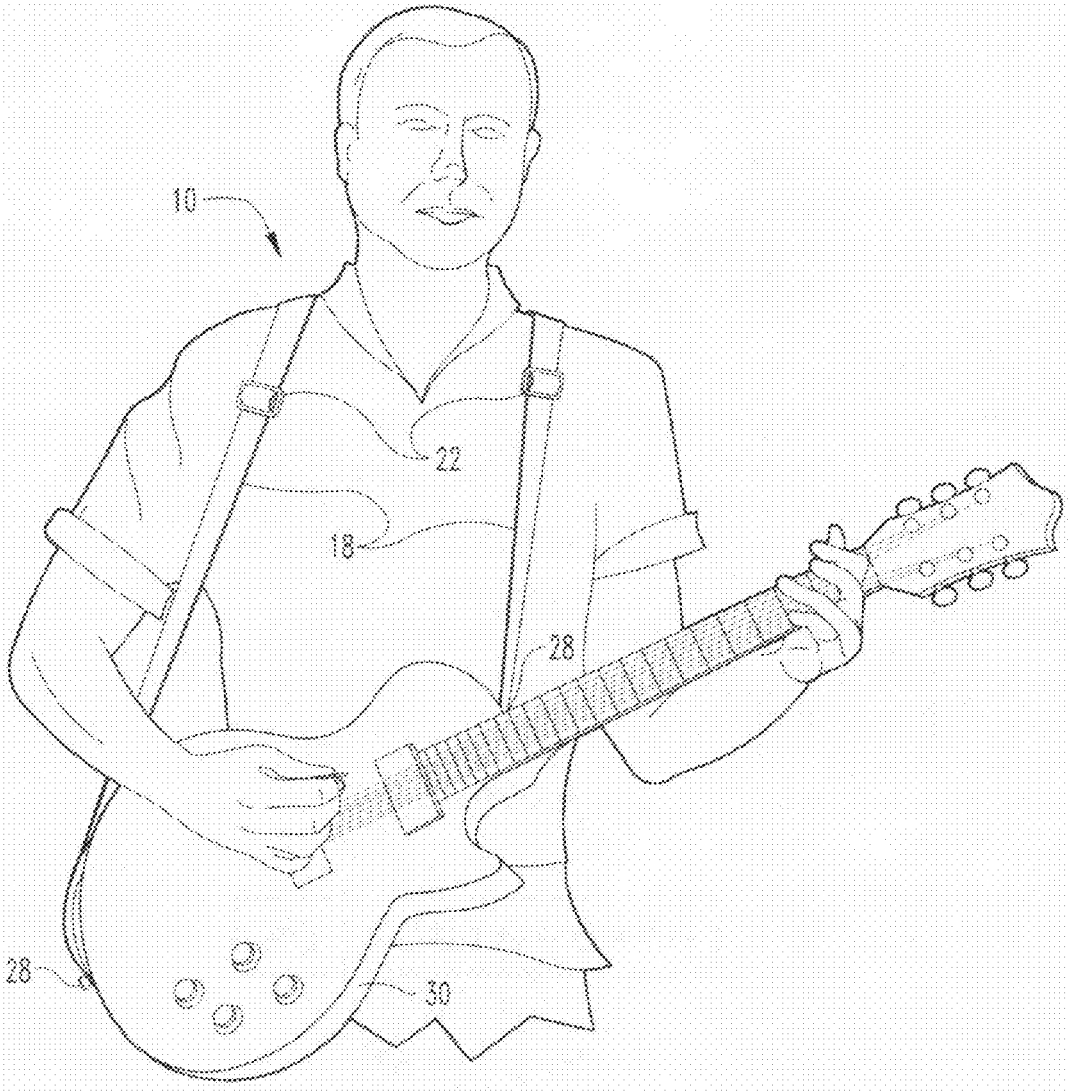
FIG. 2 is a front elevational view of the harness of FIG. 1 on a human body.

Referring now to FIG. 2, a front elevational view of the musical instrument harness 10 of FIG. 1 is shown as it is worn by the user. Harness 10 is shown attached to guitar strap buttons at 28. Strap 18 is shown looped over the users shoulders in a comfortable arrangement and distribution of the weight of guitar 30 is vertically downward on the shoulder contact areas. Also shown in FIG. 2 are triple bar strap adjustment brackets 22 useful in adjusting the length of strap 18.

Figure 3:
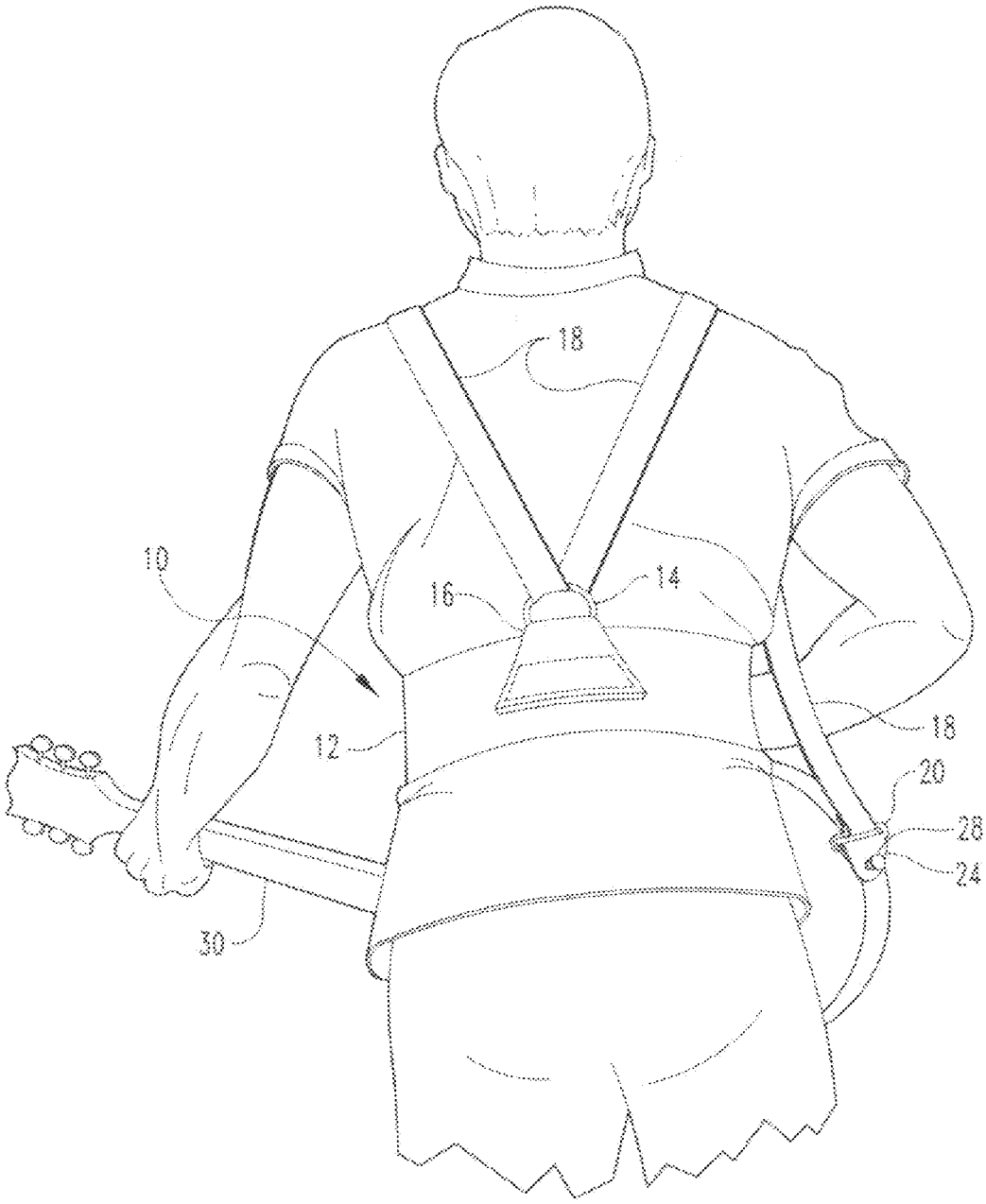
FIG. 3 is a rear elevational view of the harness of FIG. 1 depicted on a human body.

Referring now to FIG. 3, a rear elevational view of the musical instrument harness 10 of FIG. 1 is shown as worn by a user thereof. Waist belt 12 is shown surrounding the waist of the user. Extending over the shoulders of the user is strap 18. Strap 18 extends through or loops around transfer ring 14. Transfer ring 14 is shown attached to belt 12 via mounting portion 16. Strap 18 is attached at 28 to standard guitar strap buttons.

Figure 4:
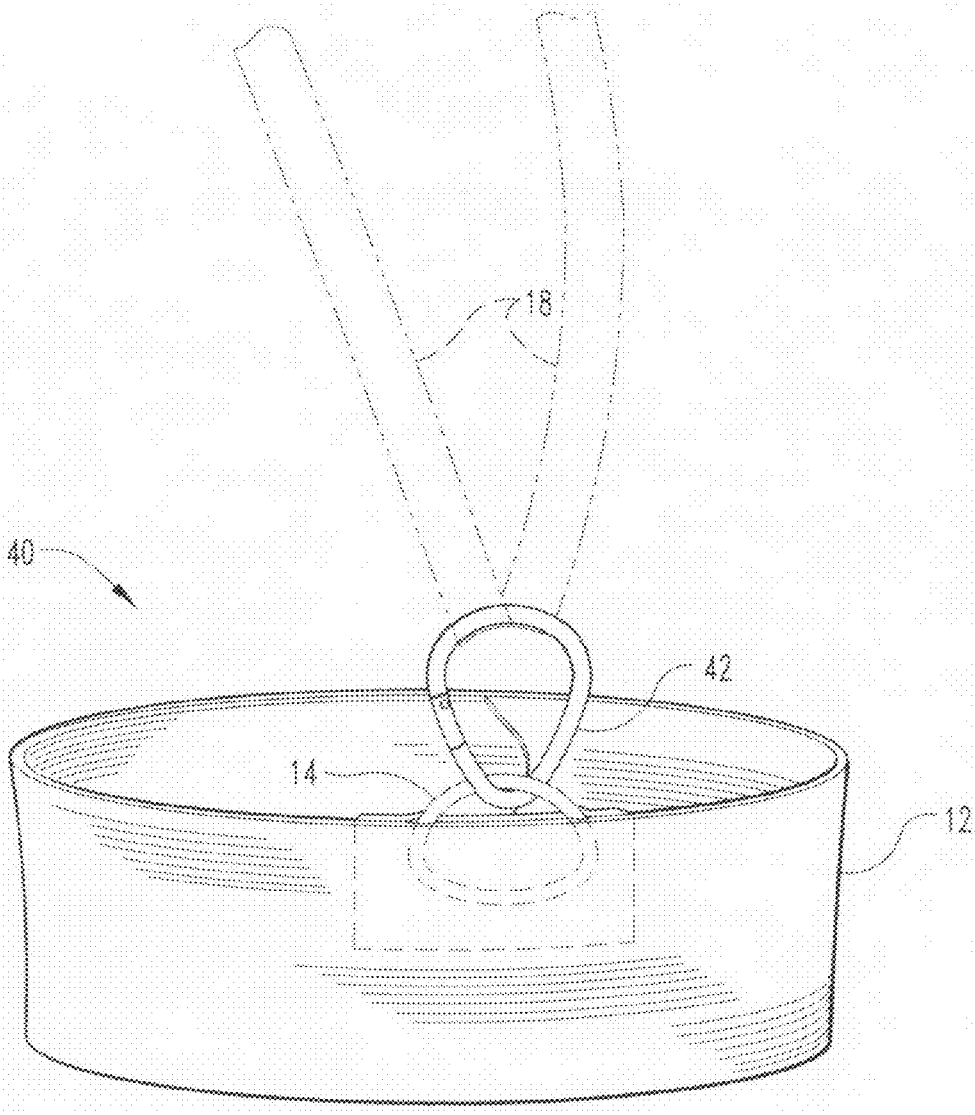
FIG. 4 is another embodiment of a musical instrument harness according to another aspect of the present invention that includes a readily detachable shoulder harness strap.

Referring now to FIG. 4, another embodiment of a musical instrument harness 40 according to another aspect of the present invention is shown. All like item numbers in FIG. 4 are identical in function and form to those same items shown in FIG. 1. In this embodiment of the harness, a detachable clip ring 42 has been added. Clip ring 42 is preferably a carabiner, which includes a spring loaded leg that is movable to attach or detach clip ring 42 from transfer ring 14. Strap 18 is identical to strap 18 of FIG. 1. Also of note in this embodiment is the structure used for attaching ring 14 to belt 12. Ring 14 is sewn into belt 14 to arrive at a more aesthetically pleasing design and less expensive design. The use of clip ring 42 provides more convenient detachment of strap 18 from belt 12. Convenience in detaching and attaching various musical instruments arises when an artist uses several instruments during a performance and the ability to rapidly detach and attach other instruments, with strap 18 already attached thereto, is achieved. Thus a user need not remove belt 12 to switch to another guitar with usage of harness 40. Such convenience is desirable during a musicians live performance.

While the invention has been illustrated and described in detail in the drawings and foregoing description of the preferred embodiments, the same is to be considered as illustrative and not restrictive in character, it being understood that only the preferred embodiments have been shown and described and that all changes and modifications that come within the spirit of the invention are desired to be protected.

What is claimed is:

1. A musical instrument harness comprising:

a waist belt adapted to be worn about the waist of a user wherein said waist belt includes an enlarged portion that is situated over the lower spinal area of the user;

a mounting ring attached to said waist belt adjacent the users spine;

an elongated harness strap and sized in length to extend over both shoulders of the user when said waist belt is situated with said mounting ring disposed adjacent the spine of the user thereof;

clip ring means movably situated over said elongated harness strap, said clip ring means being removably attachable to said mounting ring;

two triple bar strap adjustment brackets attached to said elongated harness strap, one each situated between the center of said elongated harness strap and the distal ends thereof to provide length adjustment of said elongated harness strap; and means for attaching a musical instrument situated at the distal ends of said elongated harness strap.

2. A musical instrument harness comprising:

a belt adapted to be worn about the waist of a user wherein said belt includes an enlarged portion that is situated over the lower spinal area of the user;

a mounting ring attached to said belt adjacent the users spine;

clip means removably attachable to said mounting ring;

an elongated flexible harness strap situated within and through said clip means and sized in length to extend over both shoulders of the user when said belt is situated with said mounting ring disposed adjacent the spine of the user thereof and wherein said harness strap includes apertures at the distal ends thereof for attaching a musical instrument thereto; and two triple bar strap adjustment brackets attached to said harness strap, one each situated between the center of said harness strap and the distal ends thereof to provide length adjustment of said harness strap.

3. A musical instrument harness comprising:

a belt adapted to be worn about the waist of a user wherein said waist belt includes an enlarged portion that is situated over the lower spinal area of the user;

a mounting ring attached to said belt adjacent the users spine;

an elongated flexible harness strap situated within and through said mounting ring and sized in length to extend over both shoulders of the user when said belt is situated with said mounting ring disposed adjacent the spine of the user thereof and wherein said harness strap includes apertures at the distal ends thereof for attaching a musical instrument thereto;

a coupling ring movably situated over said flexible harness strap, said coupling ring being removably attachable to said mounting ring and wherein said coupling ring is a carabiner; and two triple bar strap adjustment brackets attached to said flexible harness strap, one each situated between the center of said elongated flexible harness and the distal ends thereof to provide length adjustment of said flexible harness strap.

* * * * *